US012605609B2

(12) United States Patent
Lee

(10) Patent No.: US 12,605,609 B2
(45) Date of Patent: Apr. 21, 2026

(54) GOLF PLATE APPARATUS PROVIDED WITH HEIGHT ADJUSTER

(71) Applicant: GSPI CO., LTD., Daejeon (KR)

(72) Inventor: San Bok Lee, Daejeon (KR)

(73) Assignee: GSPI CO., LTD., Daejeon (KR)

( * ) Notice: Subject to any disclaimer, the term of this patent is extended or adjusted under 35 U.S.C. 154(b) by 329 days.

(21) Appl. No.: 18/550,648

(22) PCT Filed: Mar. 14, 2022

(86) PCT No.: PCT/KR2022/003548

§ 371 (c)(1),
(2) Date: Sep. 14, 2023

(87) PCT Pub. No.: WO2022/197046

PCT Pub. Date: Sep. 22, 2022

(65) Prior Publication Data

US 2024/0139603 A1 May 2, 2024

(30) Foreign Application Priority Data

Mar. 16, 2021 (KR) ..... 10-2021-0034276
Jun. 2, 2021 (KR) ..... 10-2021-0071374

(51) Int. Cl.
*A63B 69/36* (2006.01)

(52) U.S. Cl.
CPC .... *A63B 69/3661* (2013.01); *A63B 2225/093* (2013.01)

(58) Field of Classification Search
CPC ..... A63B 69/3661; A63B 2225/093; A63B 2225/09; A63B 69/36
USPC ..... 473/157–166, 171, 181, 278, 279
See application file for complete search history.

(56) References Cited

U.S. PATENT DOCUMENTS 5,087,045 A * 2/1992 Kim ..... A63B 67/02 473/152
5,358,251 A * 10/1994 Ashton ..... A63B 69/3652 473/279
5,820,478 A * 10/1998 Wood ..... A63B 69/3652 473/279
6,338,682 B1 * 1/2002 Torchia ..... A63B 67/02 473/160
9,987,543 B2 * 6/2018 Coffman ..... A63B 69/3661
9,993,712 B2 * 6/2018 Coffman ..... A63B 67/02
(Continued)

FOREIGN PATENT DOCUMENTS

KR 1020090117562 A 11/2009
KR 1020090130485 A 12/2009
(Continued)

*Primary Examiner* — Nini F Legesse
(74) *Attorney, Agent, or Firm* — Rabin & Berdo, P.C.

(57) ABSTRACT

A golf plate device has a height adjustment part, a frame part and a plate part. The height adjustment part includes a plurality of actuators which are installed on the frame part at regular intervals to allow for individual operation. The plate part is made of a material which is deformable and restorable by elasticity. The golf plate device varies the planar shape of the plate part, which can be deformed and restored by the actuators of the height adjustment part, into a curved shape, thereby facilitating the emulation of the terrain environment of fairways and roughs of outdoor practice ranges, which have curved terrain.

9 Claims, 13 Drawing Sheets

(56) References Cited

U.S. PATENT DOCUMENTS

| | | | | |
|---|---|---|---|---|
| 10,137,351 | B2 * | 11/2018 | Coffman | A63B 69/3676 |
| 10,486,047 | B2 * | 11/2019 | Coffman | A63B 69/3661 |

FOREIGN PATENT DOCUMENTS

| | | | |
|---|---|---|---|
| KR | 1020170140060 | A | 12/2017 |
| KR | 1020190036797 | A | 4/2019 |
| KR | 1020200017913 | A | 2/2020 |
| KR | 102224710 | B1 | 3/2021 |

* cited by examiner

GOLF PLATE APPARATUS PROVIDED WITH HEIGHT ADJUSTER

TECHNICAL FIELD

The present invention relates to a golf plate device having a height adjustment part.

More specifically, the present invention relates to a golf plate device having a height adjustment part, in which a planar shape of a plate part made of an elastic material capable of deformation and restoration by an actuator of a height adjustment part is varied into a curved shape, thereby facilitating the emulation of the terrain environment of fairways and roughs of outdoor practice ranges, which have curved terrain.

BACKGROUND ART

In general, golf is a sport where a golfer strikes a white ball on a course with a club to put the ball into a hole and competes for superiority by the number of strokes taken from the starting point to the hole. That is, golf is a sport wherein a hole cup is set up at a predetermined distance, and a golfer strikes a ball with a club, such as a driver, to be put the ball into a hole cup, each course has a predetermined number of strokes, and the golfer who completes the course with the fewest number of strokes is deemed the winner.

The golf course comprises teeing ground, green, and fairway, which is the area between the teeing ground and the green. The teeing ground is where a golfer first strikes a ball, and most of golfers use a driver for the tee shot. The green is the section where the hole cup is placed, typically in the center or at the edge, and where most of golfers use a putter to roll the ball into the cup. The fairway is the section between the teeing ground and the green, where the grass is relatively short, unlike the long-grass rough, so golfers can easily strike balls. Additionally, a course may include various elements, such as hazards and bunkers.

In this instance, while the teeing ground and the green are relatively flat, the fairway and the rough which occupy the majority of the course typically have curved terrain. Therefore, on a swing plate of an indoor practice range having uninclined ground surface, a golfer cannot produce the condition of swinging in the curved terrain of the fairway or the rough of an outdoor practice range.

To solve the above problem, Korean Patent Publication No. 10-2017-0001318 discloses a technology for an indoor golf range swing plate that can adjust a slope angle relative to the ground. The swing plate disclosed in Korean Patent Publication No. 10-2017-0001318 comprises a plurality of sliding rods installed under the plate and sliding upward or downward, a nut bearing block that slides the sliding rods, and a motor that rotates the nut bearing block. That is, the height of the plurality of sliding rods can be varied independently by the rotational force of the motor, and the plate can be inclined from the ground due to the different height values of the varied sliding rods.

However, the swing plate disclosed in the publication can make the terrain with a predetermined inclination, but cannot make terrain with a curved surface that have inflection points formed by concave or convex central portions. That is, there is a limitation in producing terrain that golfers frequently encounter in outdoor practice ranges.

DISCLOSURE

Technical Problem

Accordingly, the present invention has been made in view of the above-mentioned problems occurring in the related art, and it is an object of the present invention to provide a golf plate device having a height adjustment part, in which a planar shape of a plate part made of an elastic material capable of deformation and restoration by an actuator of a height adjustment part is varied into a curved shape, thereby facilitating the emulation of the terrain environment of fairways and roughs of outdoor practice ranges, which have curved terrain.

Technical Solution

To accomplish the above-mentioned objects, according to the present invention, there is provided a golf plate device including: a frame part; a plate part 200 which is provided on the top of the frame part in a planar rectangular shape; and a height adjustment part which includes a plurality of actuators which are installed on the frame part at regular intervals to allow for individual operation, thereby adjusting the height of the plate part, wherein the plate part is made of a material which is deformable and restorable by elasticity, and in a case in which the height is adjusted by the plurality of actuators, the planar shape of the plate part is varied into a curved surface shape.

Moreover, the actuators are installed at an acute angle relative to the frame part, are installed to be rotatable with respect to the frame part and the plate part, and during the height adjustment of the plate part, and make the pistons extend and retract while maintaining the acute angle, thereby adjusting the height of the plate part.

Furthermore, in the case in which there are four actuators forming the height adjustment part, first to fourth actuators are respectively installed adjacent to the corners of the plate part, in the case in which there are five actuators forming the height adjustment part, first to fourth actuators are respectively installed adjacent to the corners of the plate part, and a fifth actuator is installed at the center of the plate part, and in the case in which there are six actuators forming the height adjustment part, first to fourth actuators are respectively installed adjacent to the corners of the plate part, a fifth actuator is installed between the first actuator and the second actuator, and a sixth actuator is installed in a position symmetrical to the fifth actuator.

Additionally, in the case in which there are five actuators, the height adjustment part includes a center support module configured to assist with the central height adjustment of the plate part by the fifth actuator, and the center support module is configured such that one end is installed on the frame part and the other end is installed on the plate part, and the fifth actuator is installed at a connection part protruding at a position relatively close to the other end.

In addition, the height adjustment part includes a first damper which is installed on the frame part to elastically support the lower portion of the plate part whose height is adjusted by the actuators.

Moreover, the height adjustment part includes a second damper which is installed at the center of the frame part to elastically support the lower portion of the plate part whose height is adjusted by the actuators.

Furthermore, the height adjustment part includes a restoration module which is configured such that one end is installed on the frame part to be adjacent to the actuator and the other end is installed on the plate part to be positioned outside the connection part between the actuators and the plate part.

Additionally, the golf plate device further includes: a control part which configured to control the actuators to adjust the height of the plate part; and a user terminal part which can transmit signals for controlling the actuators to adjust the height of the plate part by the actuators.

Moreover, the control part includes: a main communication module for signal transmission and reception; a processing module configured to process control signals of the height adjustment part based on signals received through the main communication module; and a battery module configured to supply power.

In addition, the control part includes a sensing module which is configured to detect the status of the plate part adjusted in height by signal-processing of the processing module, the control part processes the status of the plate part detected by the sensing module as current plate information and transmit the current plate information, and the user terminal part receives and displays the current plate information transmitted from the control part.

Advantageous Effect

According to the present invention, the golf plate device having a height adjustment part varies the planar shape of the plate part made of an elastic material, which can be deformed and restored by the actuator of the height adjustment part, into a curved shape, thereby facilitating the emulation of the terrain environment of fairways and roughs of outdoor practice ranges, which have curved terrain.

Moreover, according to the present invention, the actuator which adjusts the height of the plate part to vary the planar shape of the plate part into a curved surface shape is installed at an acute angle relative to the frame part and maintains the acute angle during the height adjustment of the plate part, and the height of the plate part is adjusted by extension and retraction of the piston. Accordingly, the golf plate device according to the present invention can prevent the actuator from breaking due to excessive load, as the load generated from the plate part is not transferred solely to the actuator but is also dispersed in the rotational direction of the actuator.

Additionally, according to the present invention, the number and installation positions of the actuators of the height adjustment part can be changed and applied according to the size (area) of the frame part and the plate part. Accordingly, the golf plate device according to the present invention can efficiently support the load generated by the plate part and realize the curved surface shape of the plate part, and can be used indoors or outdoors depending on the size (area) of the frame part and the plate part.

Furthermore, according to the present invention, one or more of the center support module, the first damper, and the second damper are selectively installed to support the load generated by the plate part, thereby ensuring efficient support of the load generated from the plate part of which the planar shape is varied into a curved surface shape.

In addition, the golf plate device having a height adjustment part according to the present invention includes the restoration module which is installed outside of the connection part between the actuator and the plate part to connect the frame part and the plate part, thereby preventing the ends of the plate part from lifting from the frame part when the plate part adjusted in the height by the actuator returns to its original planar shape.

Moreover, the golf plate device having a height adjustment part according to the present invention includes the control part which transmits a control signal to control the actuator of the height adjustment part by using the user terminal part of a smart device or the like, thereby providing portability and easy use indoors and outdoors.

DESCRIPTION OF DRAWINGS

FIGS. 1*a* to 1*d*0 are block diagrams of the control part of the golf plate device having the height adjustment part according to the present invention.

FIGS. 1*a* to 1*d*1 are block diagrams of the user terminal part of the golf plate device having the height adjustment part according to the present invention.

MODE FOR INVENTION

The terms and words used in the specification and the claims should not be limited to the literal or commonly employed sense, but should be construed in accordance with the spirit of the invention as described herein. The description of the various embodiments is to be construed as exemplary only and does not describe every possible instance of the invention.

Therefore, the embodiments and configurations shown in the specification and drawings are merely exemplary and not meant to represent the entirety of the technical spirit of the invention. It should be understood that there could be various equivalents and modified examples that could substitute for them at the time of filing the present specification.

Before proceeding with the description with reference to the drawings, it is clarified that matters not necessary for disclosing the gist of the present invention, i.e., known configurations that those skilled in the art could readily supply, are not shown or described specifically.

The present invention relates to a golf plate device having a height adjustment part, in which a planar shape of a plate part made of an elastic material capable of deformation and restoration by an actuator of a height adjustment part is varied into a curved shape, thereby facilitating the emulation of the terrain environment of fairways and roughs of outdoor practice ranges, which have curved terrain.

Hereinafter, a golf plate device having a height adjustment part according to the present invention will be described in detail with reference to the attached drawings.

Figure 1A:
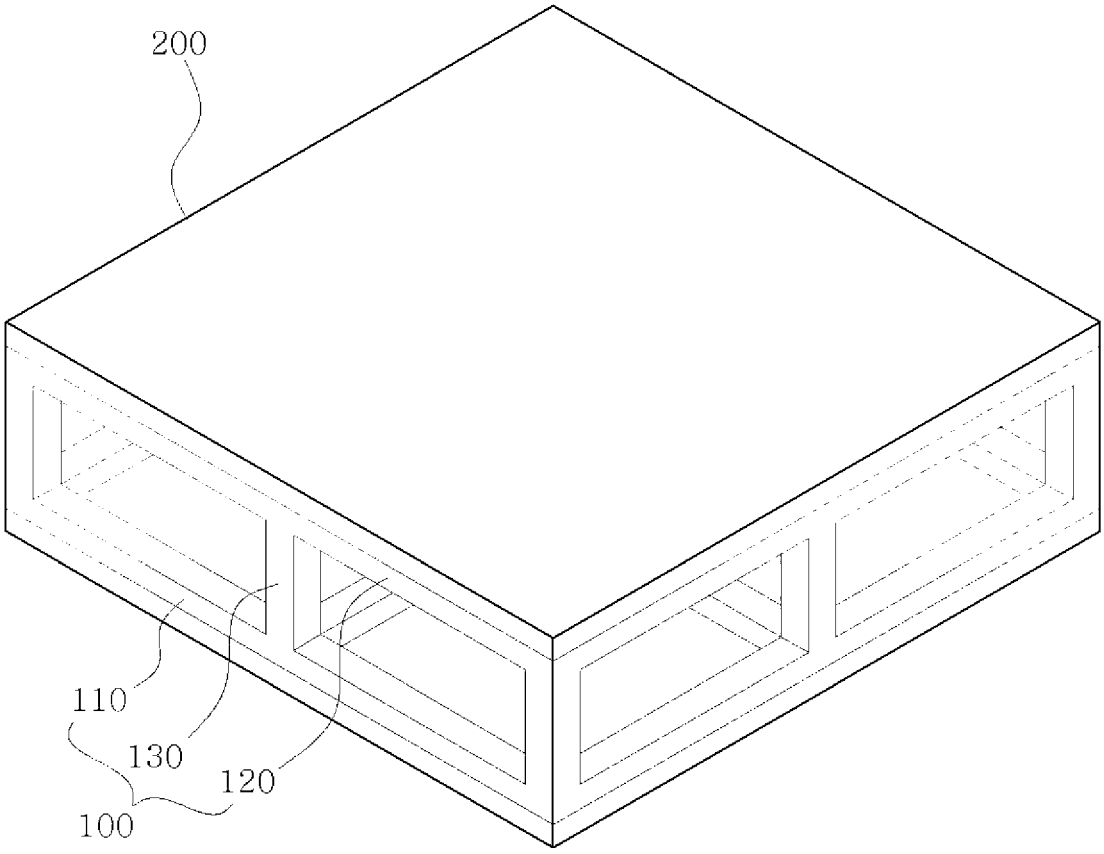
FIGS. 1*a* to 1*d* are views of a golf plate device having a height adjustment part according to the present invention.
Figure 1B:
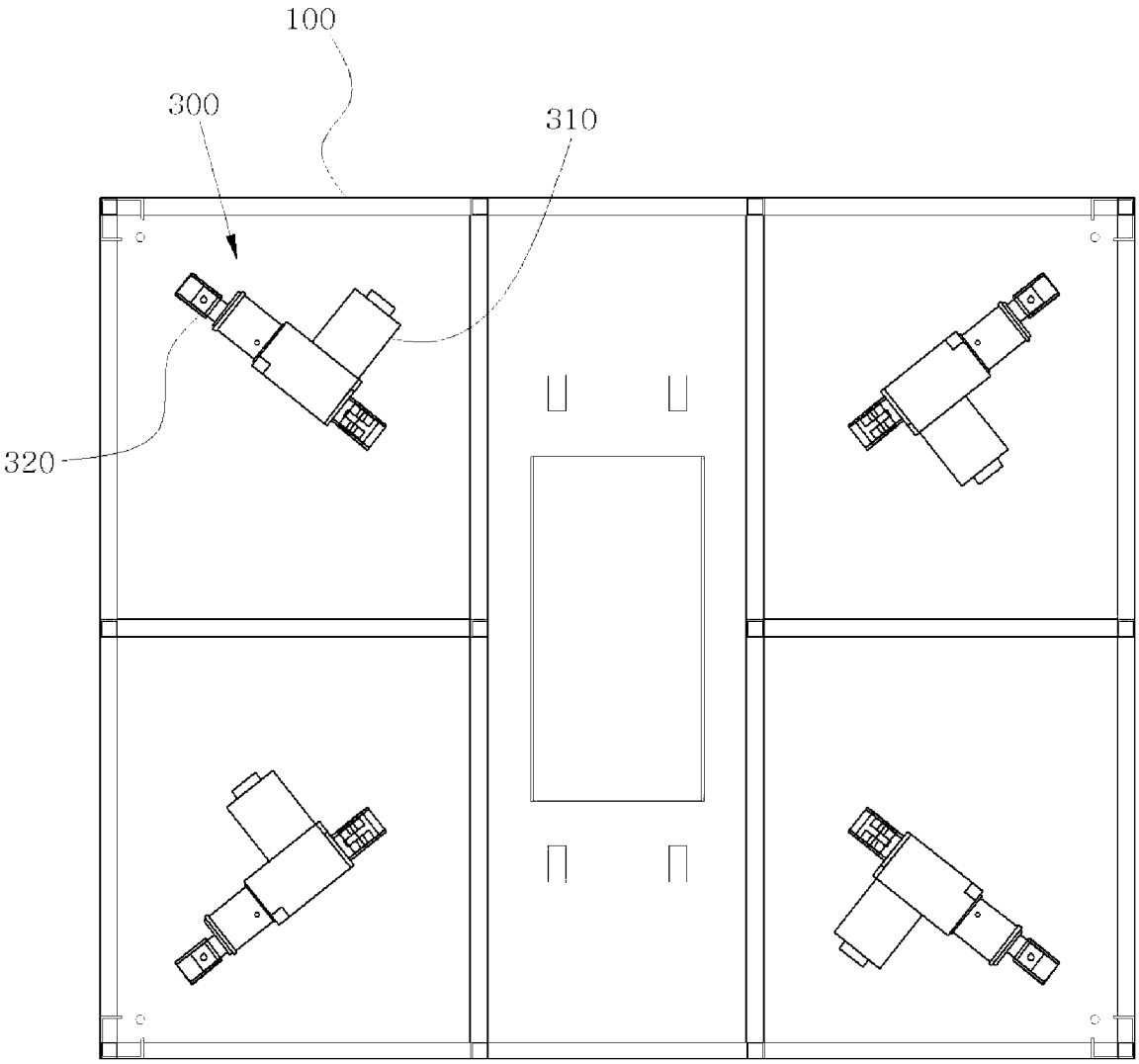
Figure 1C:
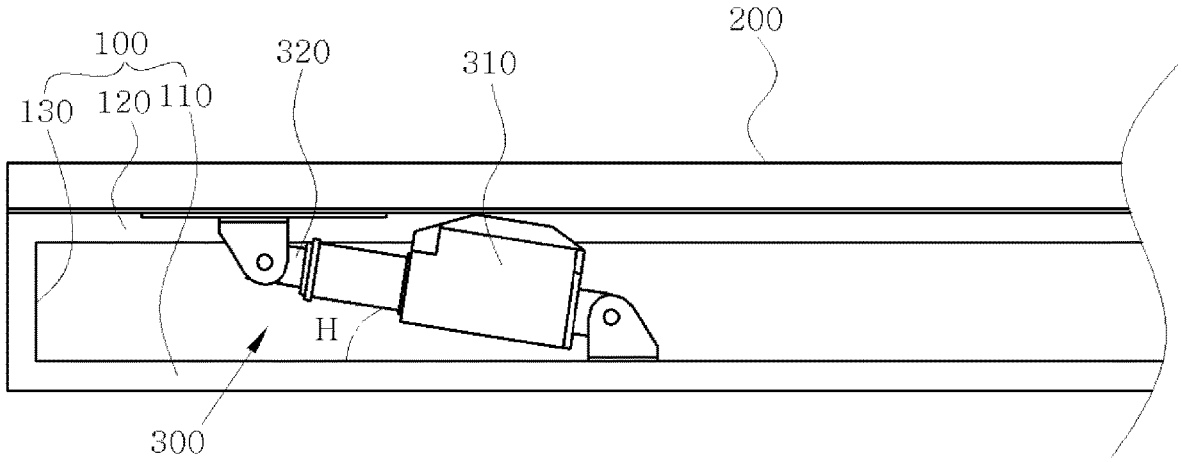
Figure 1D:
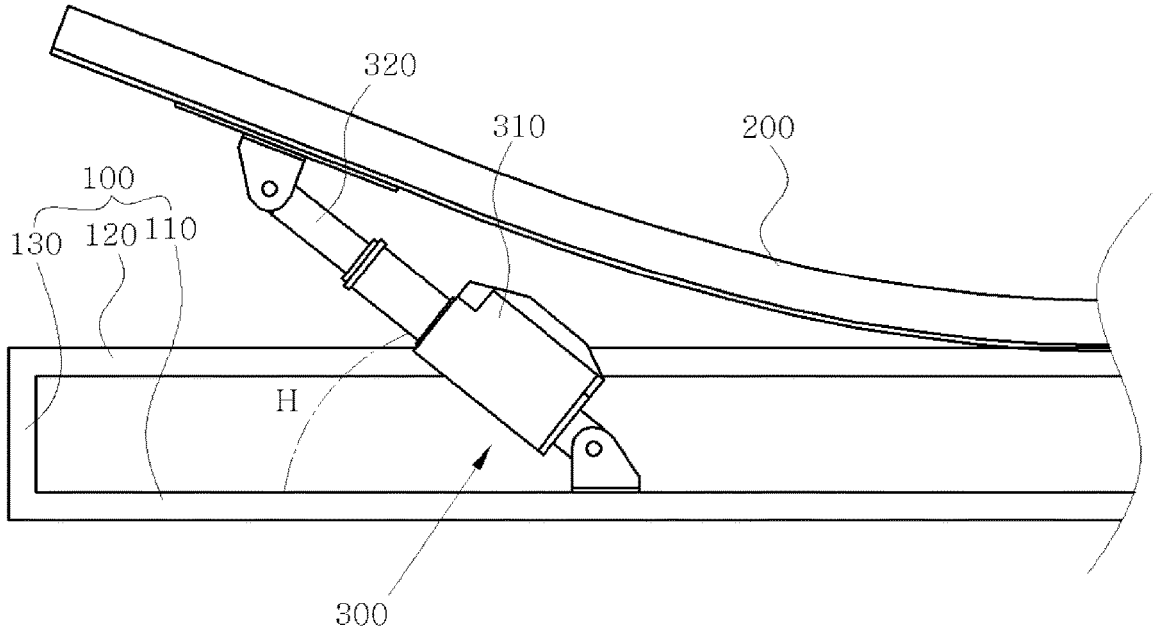
Figure 2A:
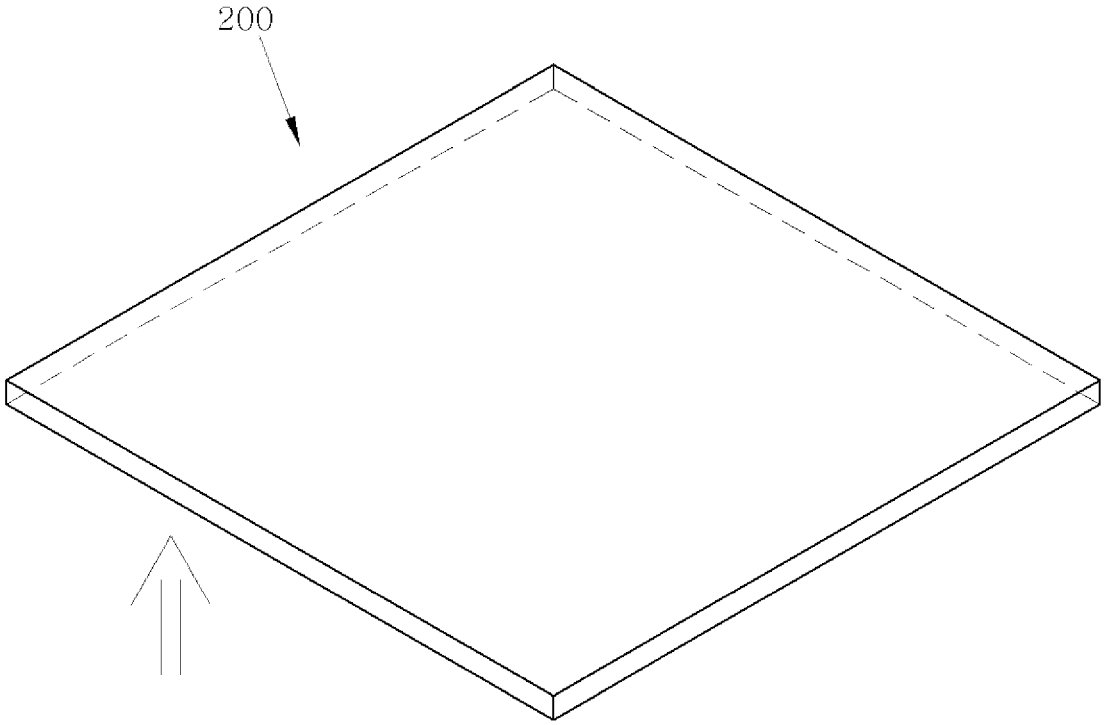
FIGS. 2*a* and 2*b* are views of a plate part of the golf plate device having a height adjustment part according to the present invention.
Figure 2B:
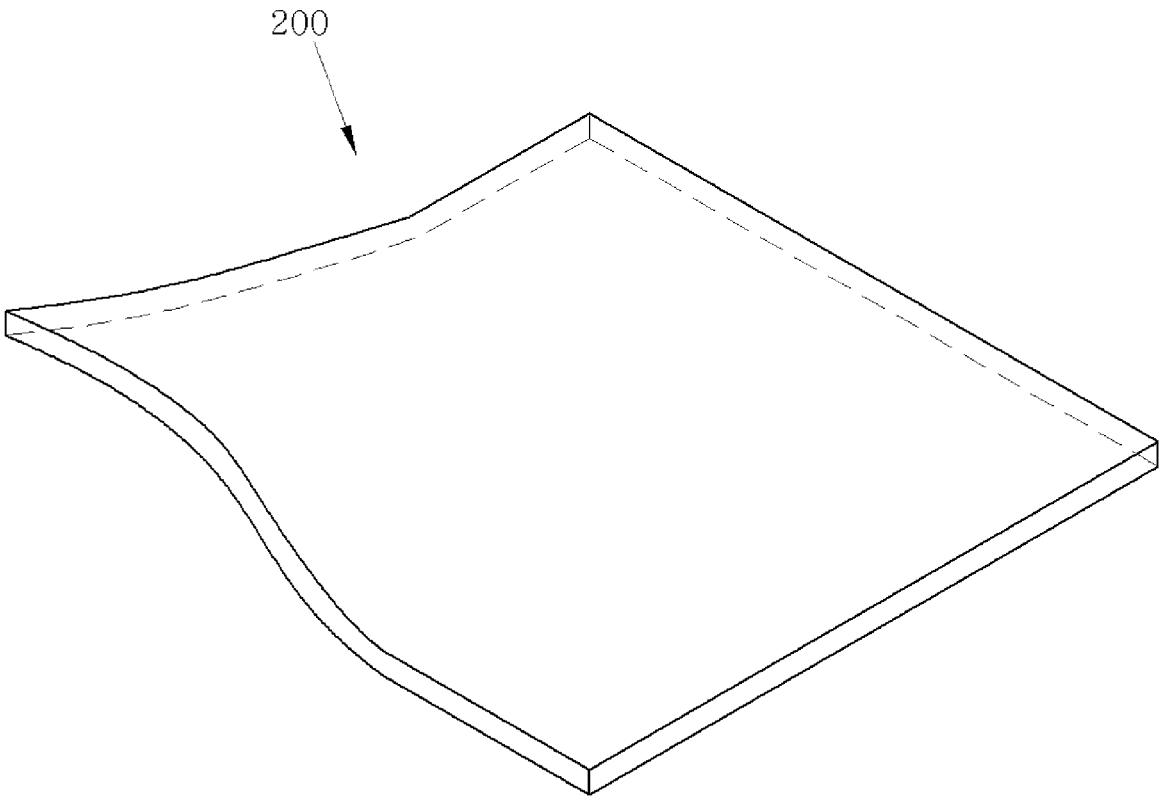
Figure 3:
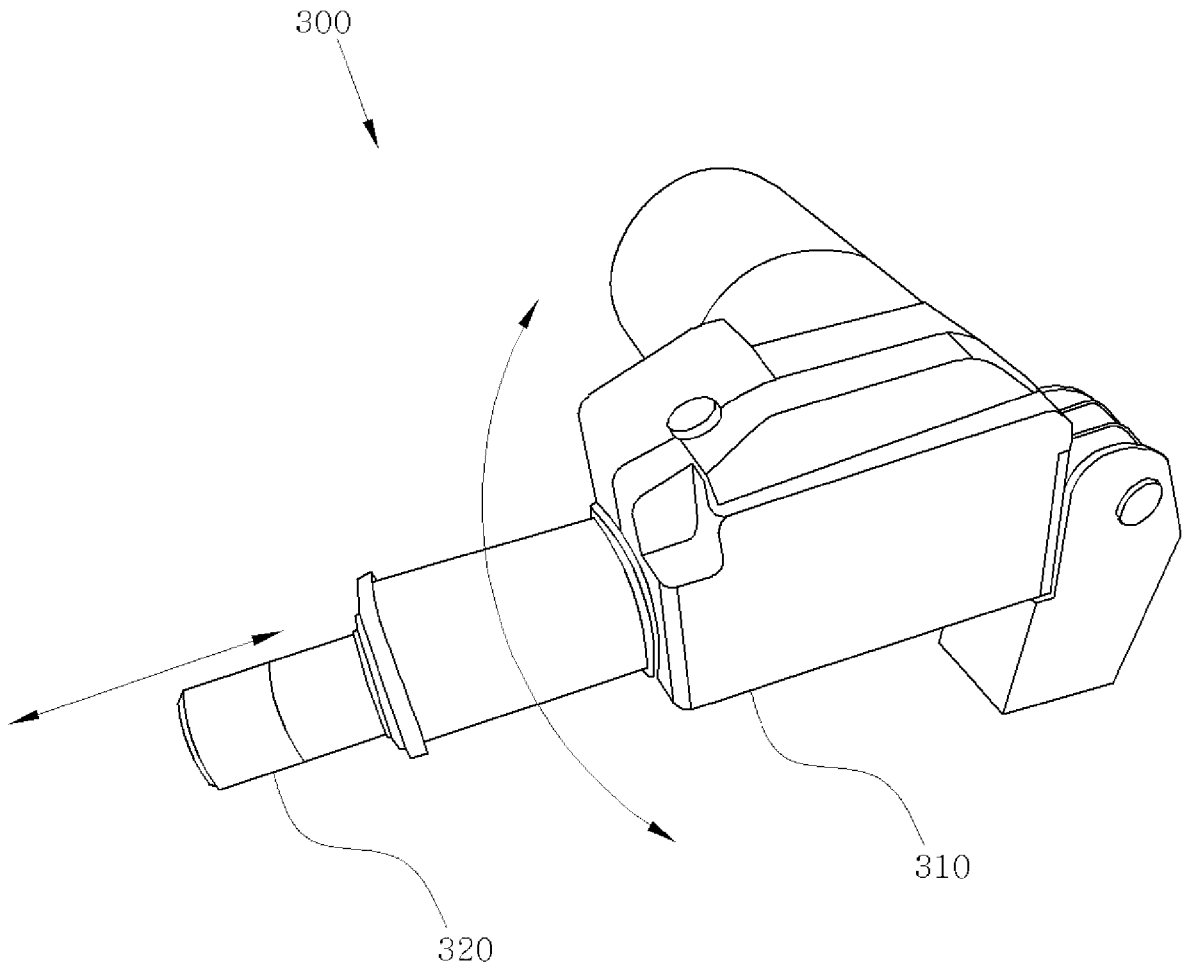
FIG. 3 is a view of a height adjustment part of the golf plate device according to the present invention.

FIGS. 1*a* to 1*d* are views of a golf plate device having a height adjustment part according to the present invention, FIGS. 2*a* and 2*b* are views of a plate part of the golf plate device having a height adjustment part according to the present invention, and FIG. 3 is a view of a height adjustment part of the golf plate device according to the present invention.

According to FIGS. 1*a* to 3, the golf plate device having the height adjustment part of the present invention includes a frame part 100, a plate part 200, and a height adjustment part 300.

The frame part 100 includes a first horizontal frame 110 which is in contact with the ground, a second horizontal frame 120 which is symmetrical to and is in contact with the plate part 200 to support the plate part 200, and a vertical frame 130 which is provided between the first horizontal frame 110 and the second horizontal frame 120 to form a predetermined space therebetween.

The vertical frame 130 is designed to locate the height adjustment part 300 within the space formed by the vertical frame 130.

The plate part 200 is formed in a planar rectangular shape and is installed on the top of the second horizontal frame 120. A user performs swing practice by standing on the top of the plate part 200.

In this instance, the plate part 200 can be formed of a material capable of deformation and restoration by elasticity, which is configured to be deformable and restorable by the height adjustment part 300. When the height adjustment part 300 adjusts the height of the plate part 200, the planar shape of the plate part 200 becomes variable to form a curved surface shape, thereby forming the terrain environment of fairways and roughs in an outdoor practice range.

The plate part 200 can be made of any material capable of deformation and restoration with elasticity, and preferably made with an aluminum board or a magnesium board.

Depending on circumstances, the plate part 200 may have a putting hole formed on one side thereof to facilitate the user's practice.

The height adjustment part 300 includes a plurality of actuators 310 which are installed on the frame part 100 at regular intervals to allow for individual operation, thereby adjusting the height of the plate part 200.

Preferably, four to six actuators 310 can be installed depending on the areas of the frame part 100 and the plate part 200 to be positioned appropriately according to their respective numbers, which will be described in detail with reference to FIGS. 4 to 6.

The plurality of actuators 310 can be installed at an acute angle relative to the frame part 100, and can be installed to be rotatable with respect to the frame part 100 and the plate part 200.

In other words, the plurality of actuators 310 can be installed to be inclined between the frame part 100 and the plate part 200, and the height adjustment part 300 is configured to adjust the height of the plate part 200 when the piston 320 is extended, in the state in which the plurality of actuators 310 are installed to be inclined.

The plurality of actuators 310 can be configured to maintain the acute angle even during the height adjustment of the plate part 200, thereby adjusting the height of the plate part 200 while the piston 320 is extended and retracted.

That is, in the state in which the plurality of actuators 310 are inclinedly installed to be rotatable state between the frame part 100 and the plate part 200, when the piston 320 is extended, the plurality of actuators 310 gradually rotate, thereby increasing an installation angle H of the plurality of actuators 310 relative to the frame part 100 and the plate part 200 such that portions of the plate part 200 where the actuators 310 are installed rise gradually upwards.

Meanwhile, the actuators 310 are configured such that even when the pistons 320 are fully extended in the plurality of actuators 310, the installation angle H of the plurality of actuators 310 maintains an acute state. Accordingly, the load generated and transmitted from the plate part 200 is not applied only to the pistons 320 extended from the actuators 310 but is dispersed also in the rotational direction of the actuators 310, thereby prevent damage to the actuators 310 and the pistons 320 due to excessive load.

Figure 4:
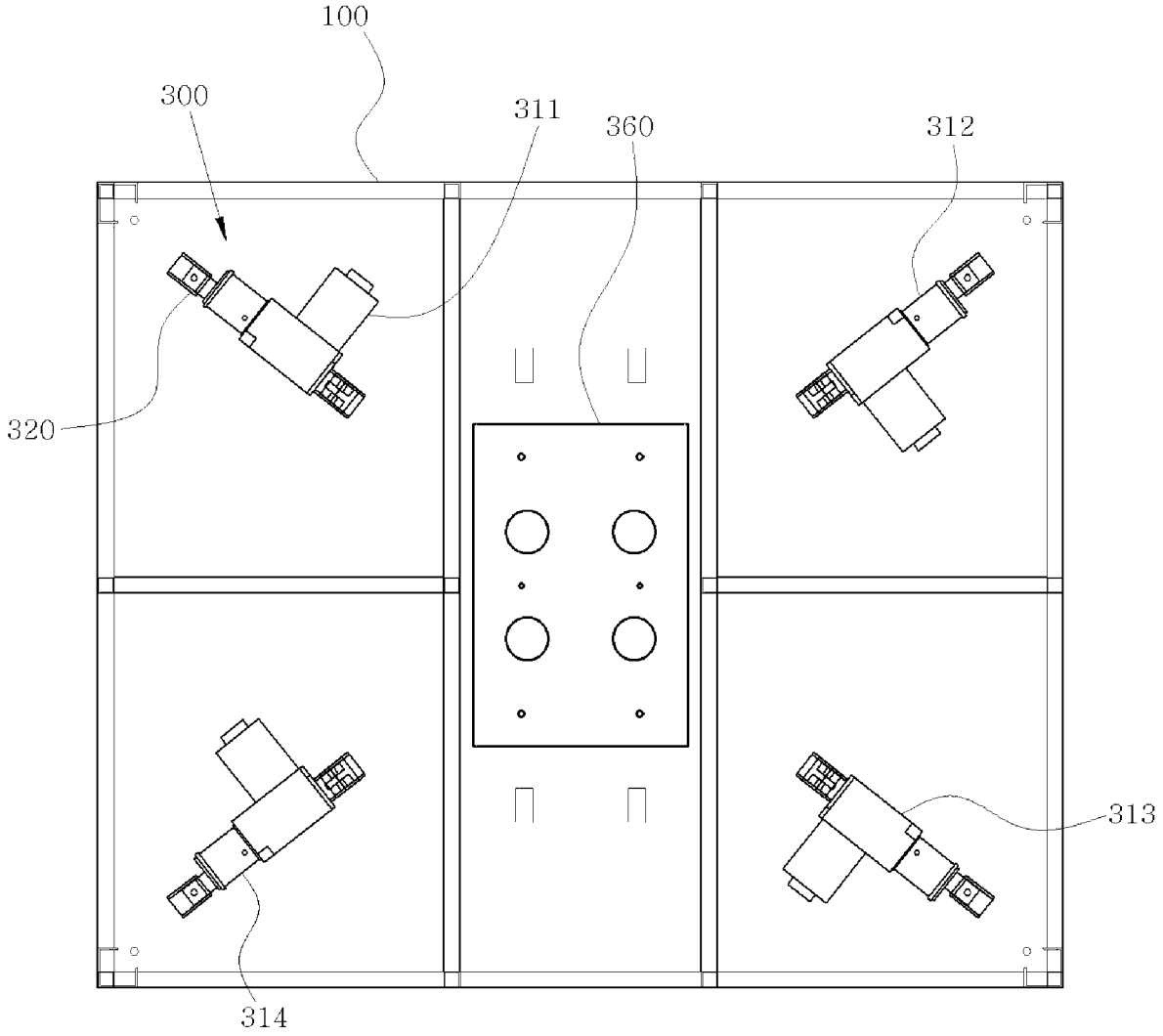
FIG. 4 is a view of a height adjustment part of the golf plate device according to a first embodiment of the present invention.
Figure 5:
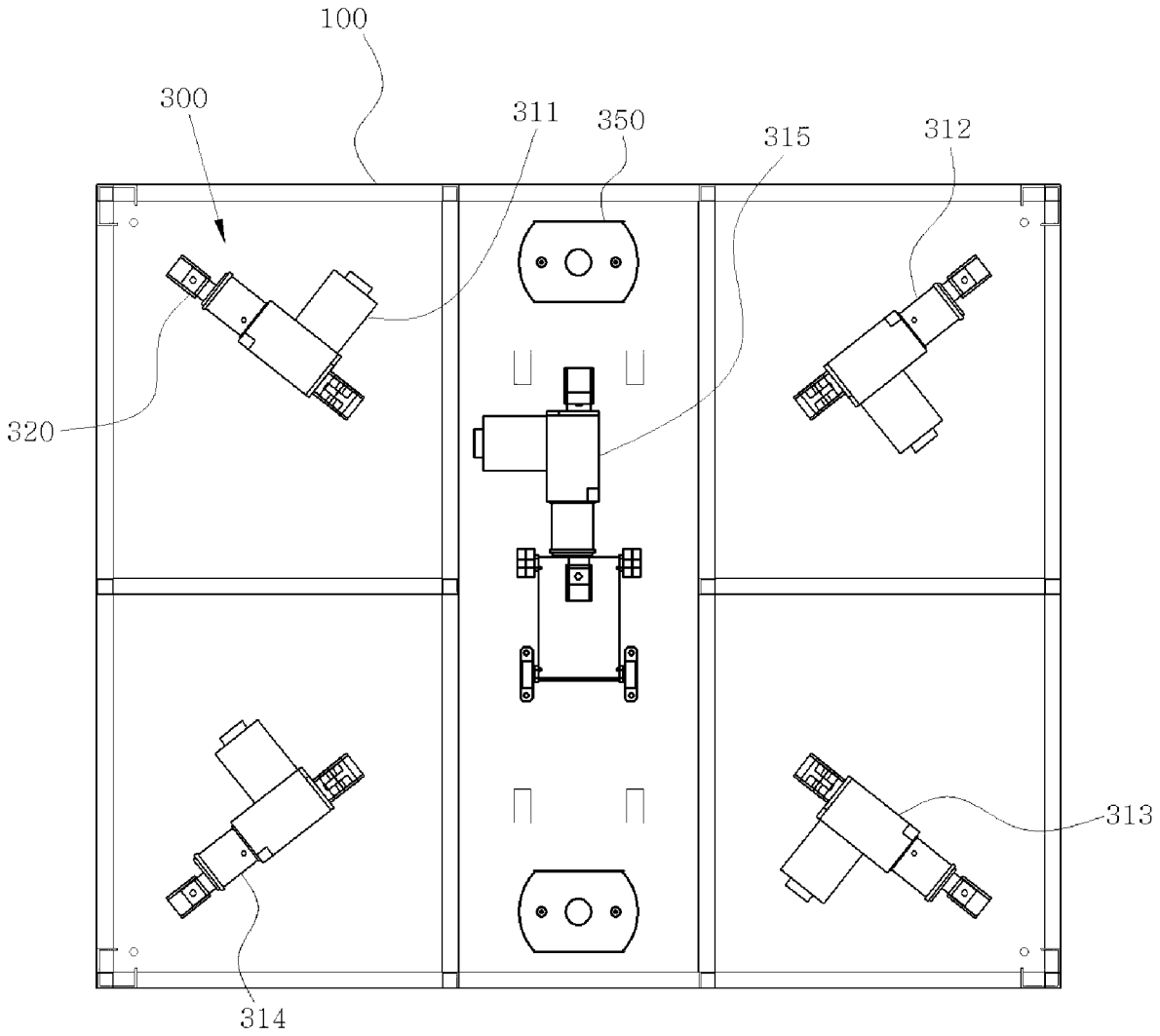
FIG. 5 is a view of a height adjustment part of the golf plate device according to a second embodiment of the present invention.
Figure 6:
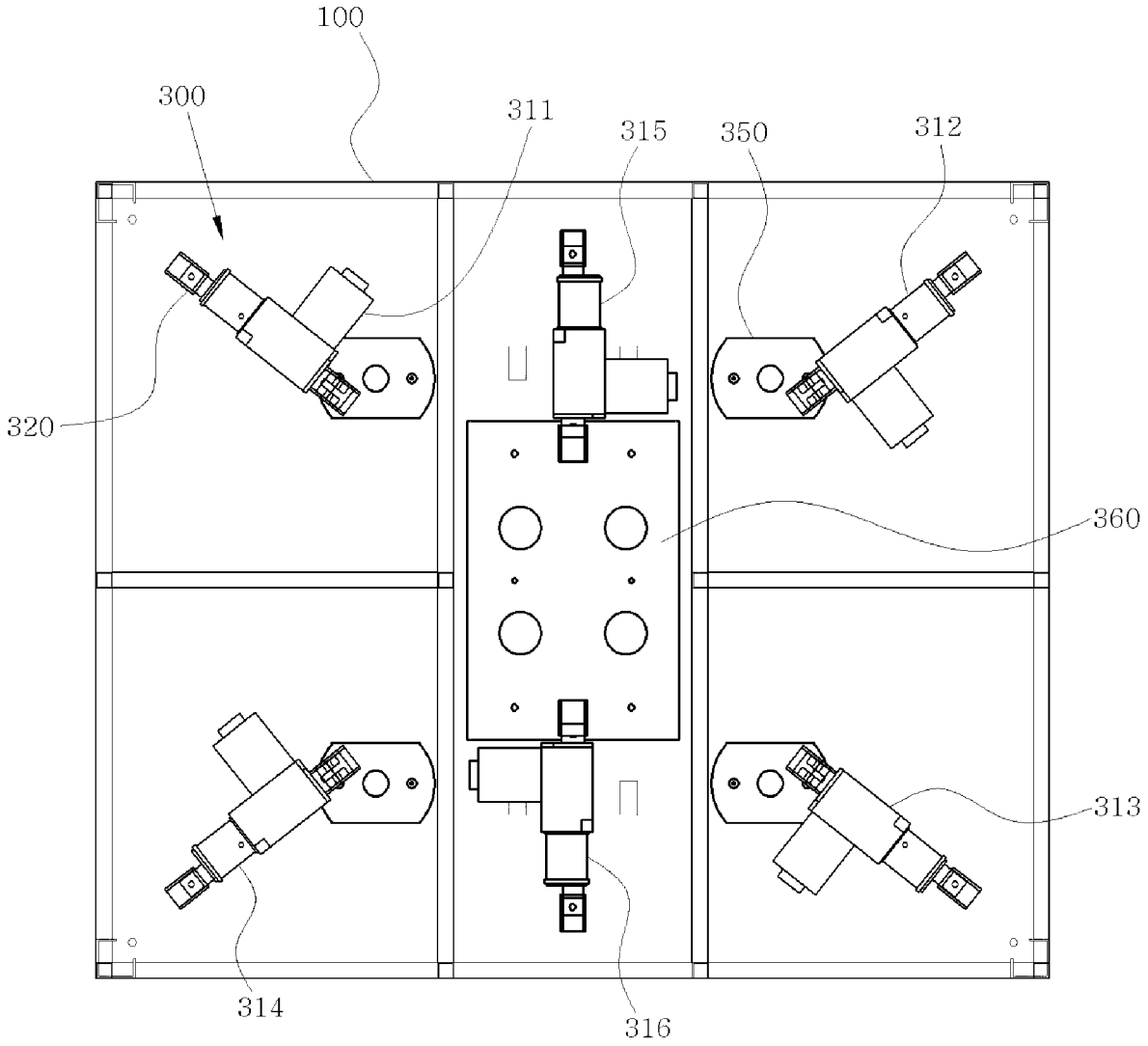
FIG. 6 is a view of a height adjustment part of the golf plate device according to a third embodiment of the present invention.

FIG. 4 is a view of a height adjustment part of the golf plate device according to a first embodiment of the present invention, FIG. 5 is a view of a height adjustment part of the golf plate device according to a second embodiment of the present invention, and FIG. 6 is a view of a height adjustment part of the golf plate device according to a third embodiment of the present invention.

According to FIGS. 4 to 6, FIG. 4 illustrates a state where there are four actuators 310 forming the height adjustment part 300, FIG. 5 illustrates a state where there are five actuators 310 forming the height adjustment part 300, and FIG. 6 illustrates a state where there are six actuators 310 forming the height adjustment part 300.

More specifically, in the case in which there are four actuators 310 forming the height adjustment part 300, first to fourth actuators 311 to 314 can be respectively installed adjacent to the corners of the plate part 200.

The first embodiment may be used when it is determined that there will be no burden with the load applied to the center of the plate part 200, even if the first to fourth actuators 311 to 314 are installed only adjacent to the corners of the plate part 200 due to the small area of the frame part 100 and plate part 200.

Furthermore, in the case in which there are five actuators 310 forming the height adjustment part 300, first to fourth actuators 311 to 314 can be respectively installed adjacent to the corners of the plate part 200, and a fifth actuator 315 can be installed at the center of the plate part 200.

The second embodiment may be used when it is determined that there will be a burden with the load applied to the center of the plate part 200, when the first to fourth actuators 311 to 314 are installed only adjacent to the corners of the plate part 200 since the area of the frame part 100 and plate part 200 is a middle size.

Additionally, in the case in which there are six actuators 310 forming the height adjustment part 300, first to fourth actuators 311 to 314 can be respectively installed adjacent to the corners of the plate part 200, a fifth actuator 315 can be installed between the first actuator 311 and the second actuator 312, and a sixth actuator 316 can be installed in a position symmetrical to the fifth actuator 315.

The third embodiment may be used when it is determined that there will be a great burden with the load applied to the center of the plate part 200, when the first to fourth actuators 311 to 314 are installed only adjacent to the corners of the plate part 200 since the area of the frame part 100 and plate part 200 is a large size.

In the present invention, it is described that the height adjustment part 300 includes four, five, or six actuators 310, but according to circumstances, if the area of the frame part 100 and the plate part 200 increases such that arranging six actuators 310 is insufficient for load support, more actuators may be installed as necessary.

Meanwhile, the height adjustment part 300 may include a first damper 350 which is installed on the frame part 100 to elastically support the lower portion of the plate part 200 whose height is adjusted by the actuators 310.

The first damper 350 may be a spring to distribute and support the load applied to the actuators 310.

Moreover, the height adjustment part 300 may also include a second damper 360 which is installed at the center of the frame part 100 to elastically support the lower portion of the plate part 200 whose height is adjusted by the actuators 310.

The second damper 360 may be a modular assembly made up of a plurality of springs, and is installed at the center of the frame part 100 to distribute and support the load applied to the actuators 310.

The strength of the springs in both the first damper 350 and the second damper 360 can be varied and applied according to the execution environment as needed.

Figure 7A:
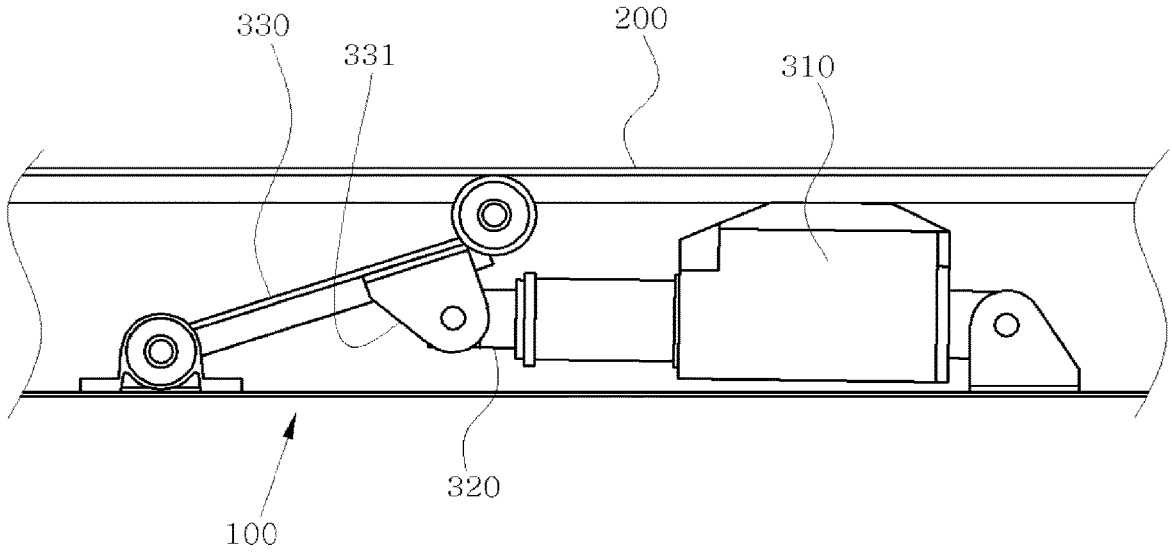
FIGS. 7*a* and 7*b* are views of a center support module of the golf plate device having the height adjustment part according to the present invention.
Figure 7B:
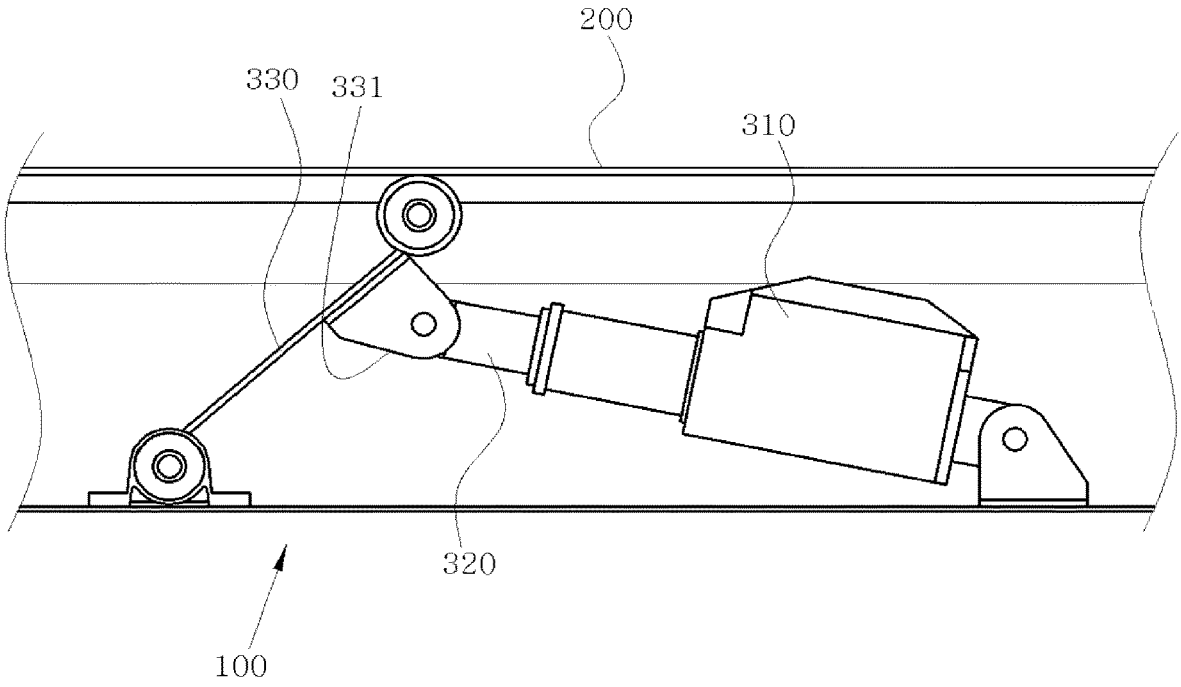
Figure 8A:
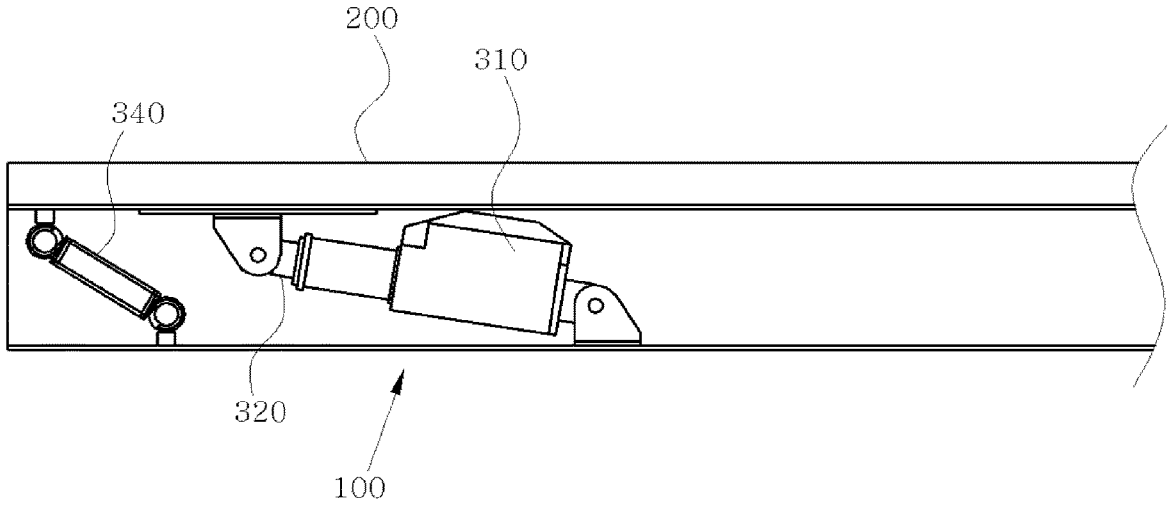
FIGS. 8*a* and 8*b* are views of a restoration module of the golf plate device having the height adjustment part according to the present invention.
Figure 8B:
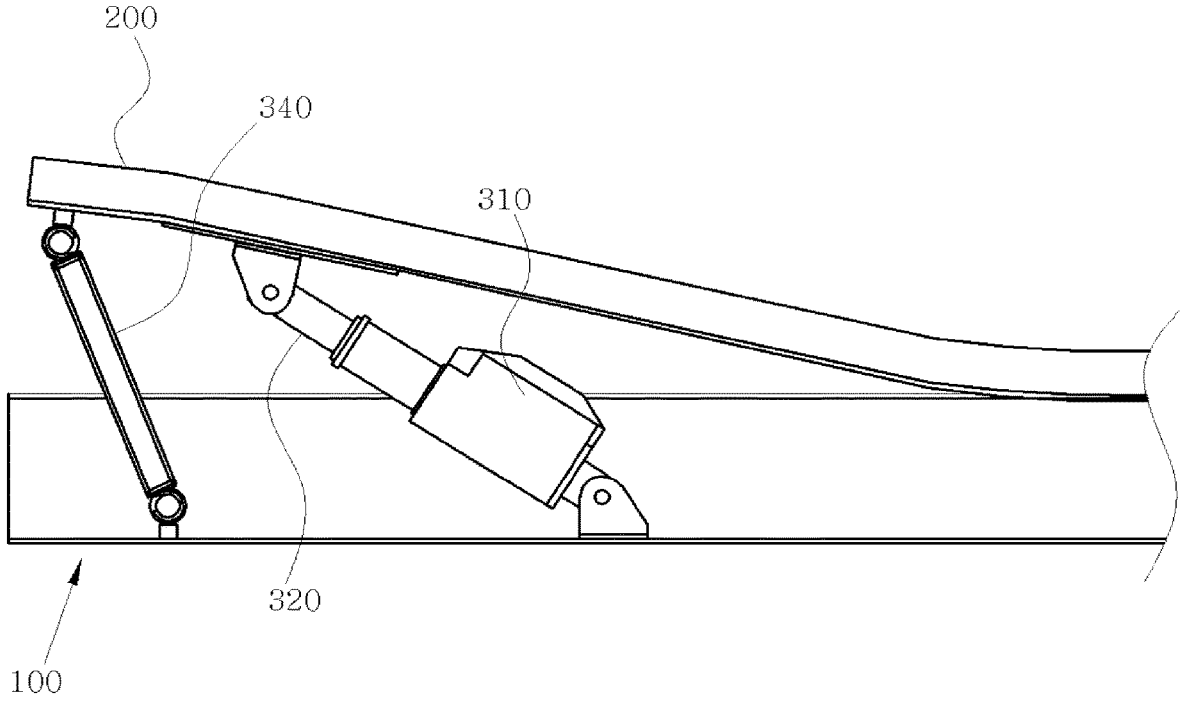

FIGS. 7*a* and 7*b* are views of a center support module of the golf plate device having the height adjustment part according to the present invention, and FIGS. 8*a* and 8*b* are views of a restoration module of the golf plate device having the height adjustment part according to the present invention.

According to FIGS. 7*a* to 8*b*, in the case in which there are five actuators 310, the height adjustment part 300 can include a center support module 330 configured to assist with the central height adjustment of the plate part 200 by the fifth actuator 315.

The center support module 330 is configured such that one end is installed on the frame part 100 and the other end is installed on the plate part 200, and the fifth actuator 315 is installed at a connection part 331 protruding at a position relatively close to the other end.

That is, when it is anticipated that the load applied from the center of the plate part 200 will increase, the center support module 330 arranges five actuators 310 not six actuators 310 to assist height adjustment of the fifth actuator which is configured to adjust the height of the center of the plate part 200.

In addition, the height adjustment part 300 may include a restoration module 340 which is configured such that one end is installed on the frame part 100 to be adjacent to the actuator 310 and the other end is installed on the plate part 200 to be positioned outside the connection part between the actuators 310 and the plate part 200.

The restoration module 340 is formed in a spring shape, and is configured such that one end is installed on the frame part 100 and the other end is installed on the plate part 200, thereby facilitating the restoration of the plate part 200 by the elastic force of the restoration module 340 when the deformation caused by the actuators 310 is not returned to its original shape during restoration of the height adjustment by the actuators 310 of the height adjustment part 300.

Figure 9:
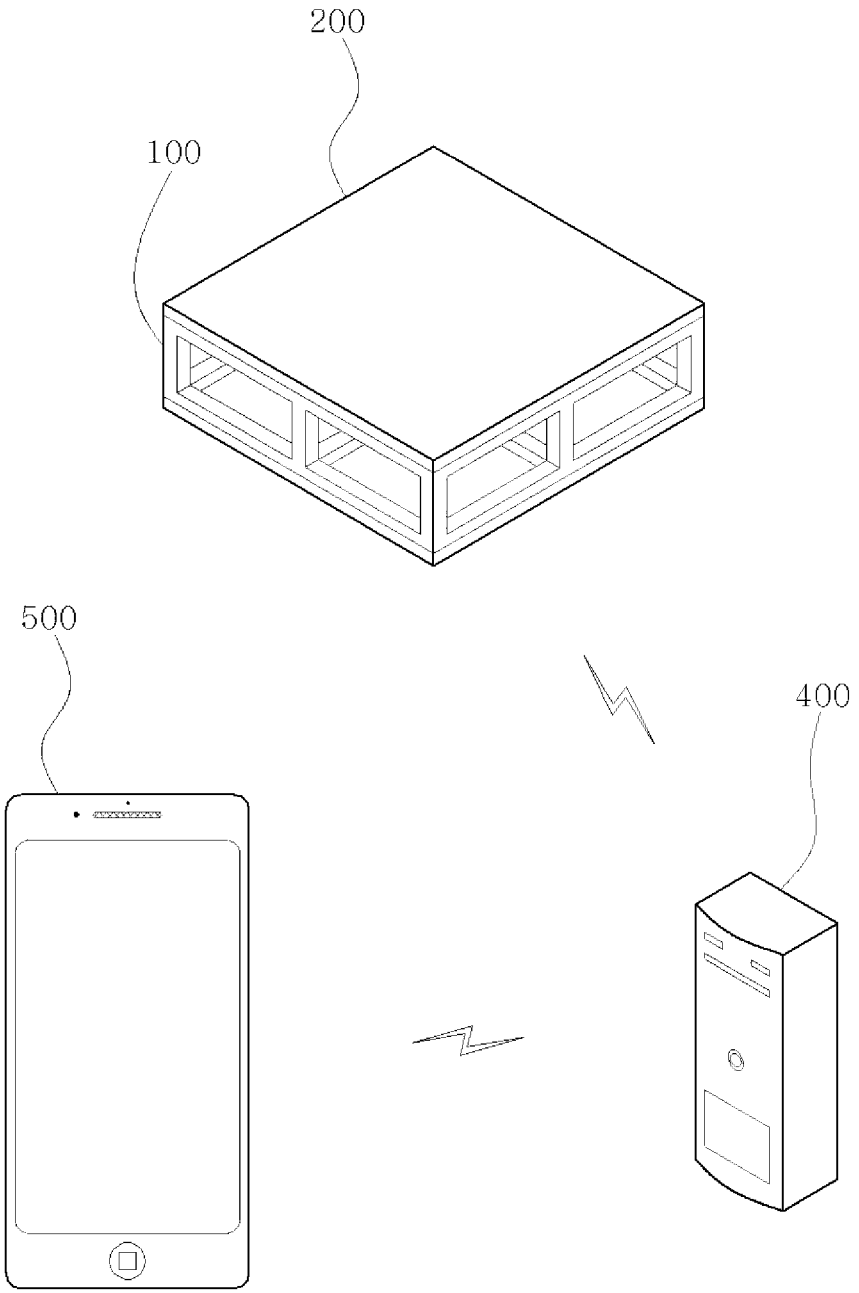
FIG. 9 is a view of a control part and a user terminal part of the golf plate device having the height adjustment part according to the present invention.
Figure 10:
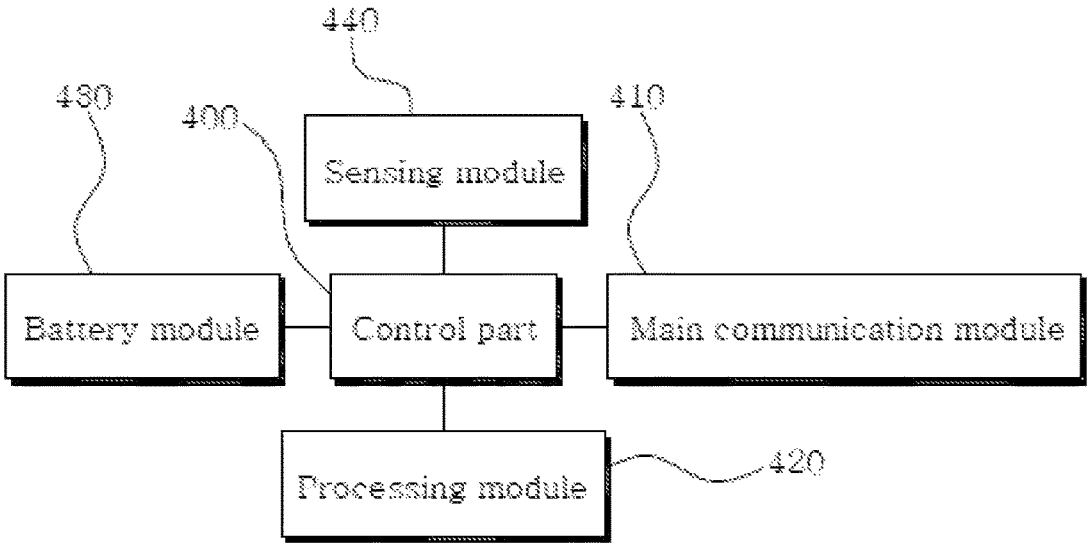
Figure 11:
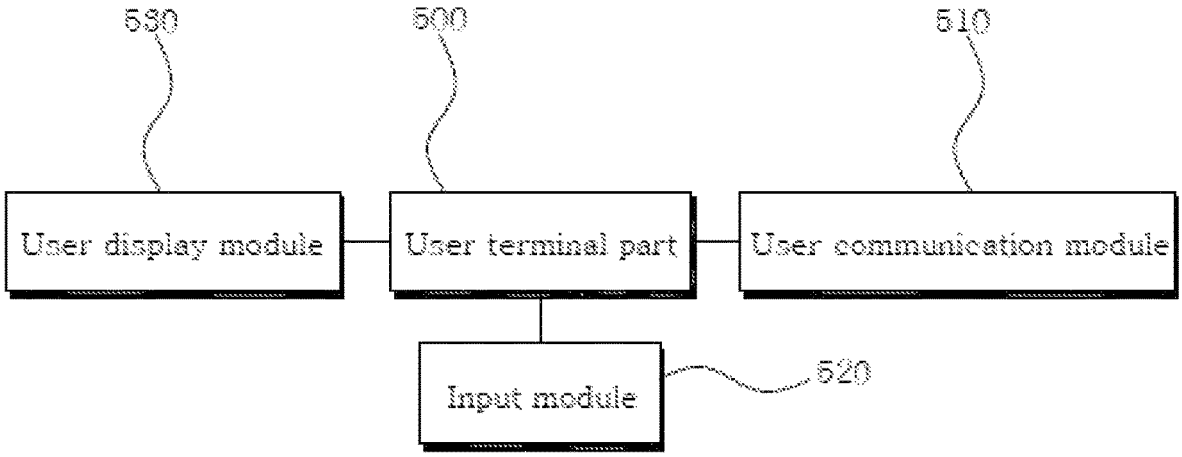

FIG. 9 is a view of a control part and a user terminal part of the golf plate device having the height adjustment part according to the present invention, FIGS. 10 is a block diagrams of the control part of the golf plate device having the height adjustment part according to the present invention, and FIGS. 11 is a block diagrams of the user terminal part of the golf plate device having the height adjustment part according to the present invention.

According to FIGS. 9, 10 and 11, the golf plate device having the height adjustment part 300 according to the present invention may further include: a control part 400 which configured to control the actuators 310 to adjust the height of the plate part 200; and a user terminal part 500 which can transmit signals for controlling the actuators 310 to adjust the height of the plate part 200 by the actuators 310.

The control part 400 may include: a main communication module 410 for signal transmission and reception; a processing module 420 configured to process control signals of the height adjustment part 300 based on signals received through the main communication module 410; and a battery module 430 configured to supply power.

In other words, as described above, the control part 400 can be configured to analyze the signals transmitted from the user terminal part 500 to control the height adjustment part 300, and may include a battery module 430, which can be used after charging to avoid the inconvenience of requiring a constant connection to a power outlet and eliminate a limitation in outdoor use.

The user terminal part 500 may include a user communication module 510 configured for signal transmission and reception, and an input module 520 formed in one or more of a touch type and a button type.

That is, as described above, the user terminal part 500 is configured to receive the signals for controlling the height adjustment part 300 through the input module 520 and transmit the signals through the user communication module 510, such that the control part 400 controls the height adjustment part 300. Accordingly, even though the user does not get in direct contact with the height adjustment part 300 and the control part 400, the height adjustment part 300 can be controlled wirelessly through the user terminal part 500, thereby facilitating the use of the golf plate outdoors, not just indoors.

Meanwhile, the control part 400 may include a sensing module 440 which is configured to detect the status of the plate part 200 adjusted in height by signal-processing of the processing module 420. The control part 400 may process the status of the plate part 200 detected by the sensing module 440 as current plate information and transmit the current plate information. The user terminal part 500 may receive and display the current plate information transmitted from the control part 400.

In other words, the golf plate device having the height adjustment part according to the present invention can allow the user to control the height adjustment part 300 by transmitting control signals to the control part 400 using the user terminal part 500, and can detect the current status of the height-adjusted plate part 200 by the sensing module 440, process the current status into current plate information by the control part 400, and transmit the current plate information to the user terminal part 500, thereby enabling the user to check the current plate information through the display module 530 of the user terminal part 500.

According to the present invention, the golf plate device having a height adjustment part can vary the planar shape of the plate part made of an elastic material, which can be deformed and restored by the actuator of the height adjustment part, into a curved shape, thereby facilitating the emulation of the terrain environment of fairways and roughs of outdoor practice ranges, which have curved terrain.

While the description above presents various embodiments of the present invention, it is understood that the invention is not limited to these examples. Those skilled in the art within the field of the present invention can recognize that various substitutions, modifications, and changes are possible without departing from the technical spirit of the invention.

The invention claimed is:

1. A golf plate device having a height adjustment part comprising:

a frame part (100);

a plate part (200) which is provided on a top of the frame part (100) in a planar rectangular shape; and a height adjustment part (300) which includes a plurality of actuators (310) which are installed on the frame part (100) at regular intervals to allow for individual operation, thereby adjusting a height of the plate part (200), wherein the plate part (200) is made of a material which is deformable and restorable by elasticity, and in a case in which the height is adjusted by the plurality of actuators, the planar rectangular shape of the plate part (200) is varied into a curved surface shape, and wherein the height adjustment part (300) includes a restoration module (340) which is configured such that one end of the restoration module (340) is installed on the frame part (100) to be adjacent to the actuator (310) and another end of the restoration module (340) is installed on the plate part (200) to be positioned outside a connection part (331) of respective connection parts (331) between the actuators (310) and the plate part (200).

2. The golf plate device according to claim 1, wherein the actuators (310) are installed at an acute angle relative to the frame part (100), are installed to be rotatable with respect to the frame part (100) and the plate part (200), and during a height adjustment of the plate part (200), and make pistons (320) extend and retract while maintaining the acute angle, thereby adjusting the height of the plate part (200).

3. The golf plate device according to claim 1, wherein in a case in which there are four actuators (310) forming the height adjustment part (300), first to fourth actuators (311 to 314) are respectively installed adjacent to corners of the plate part (200), wherein in a case in which there are five actuators (310) forming the height adjustment part (300), first to fourth actuators (311 to 314) are respectively installed adjacent to the corners of the plate part (200), and a fifth actuator (315) is installed at a center of the plate part (200), and wherein in a case in which there are six actuators (310) forming the height adjustment part (300), first to fourth actuators (311 to 314) are respectively installed adjacent to the corners of the plate part (200), a fifth actuator (315) is installed between the first actuator (311) and the second actuator (312), and a sixth actuator (316) is installed in a position symmetrical to the fifth actuator (315).

4. The golf plate device according to claim 3, wherein in the case in which there are five actuators (310), the height adjustment part (300) includes a center support module (330) configured to assist with a central height adjustment of the plate part (200) by the fifth actuator (315), and wherein the center support module (330) is configured such that one end of the center support module (330) is installed on the frame part (100) and another end of the center support module (330) is installed on the plate part (200), and the fifth actuator (315) is installed at a corresponding connection part (331), the corresponding connection part (331) protruding at a position relatively close to the other end of the center support module (330).

5. The golf plate device according to claim 1, wherein the height adjustment part (300) includes a first damper (350) which is installed on the frame part (100) to elastically support a lower portion of the plate part (200).

6. The golf plate device according to claim 1, wherein the height adjustment part (300) includes a second damper (360) which is installed at a center of the frame part (100) to elastically support a lower portion of the plate part (200).

7. The golf plate device according to claim 1, further comprising:

a control part (400) which configured to control the actuators (310) to adjust the height of the plate part (200); and a user terminal part (500) to transmit signals for controlling the actuators (310) to adjust the height of the plate part (200).

8. The golf plate device according to claim 7, wherein the control part (400) includes:

a main communication module (410) for signal transmission and reception;

a processing module (420) configured to process control signals of the height adjustment part (300) based on signals received through the main communication module (410); and a battery module (430) configured to supply power.

9. The golf plate device according to claim 8, wherein the control part (400) includes a sensing module (440) which is configured to detect a status of the plate part (200) adjusted in height by signal-processing of the processing module (420), wherein the control part (400) processes the status of the plate part (200) detected by the sensing module (440) as current plate information and transmit the current plate information, and wherein the user terminal part (500) receives and displays the current plate information transmitted from the control part (400).

* * * * *